US010829703B2

(12) United States Patent
Petri et al.

(10) Patent No.: US 10,829,703 B2
(45) Date of Patent: Nov. 10, 2020

(54) PROCESS FOR PRODUCING A NAPHTHA STREAM

(71) Applicant: UOP LLC, Des Plaines, IL (US)

(72) Inventors: John A. Petri, Wauconda, IL (US); Bryan K. Glover, Algonquin, IL (US); Andrea G. Bozzano, Northbrook, IL (US); Mary Jo Wier, Schaumburg, IL (US)

( * ) Notice: Subject to any disclaimer, the term of this patent is extended or adjusted under 35 U.S.C. 154(b) by 0 days.

(21) Appl. No.: 16/147,651

(22) Filed: Sep. 29, 2018

(65) Prior Publication Data

US 2020/0102511 A1 Apr. 2, 2020

(51) Int. Cl.

| | |
|---|---|
| ***C10G 65/12*** | (2006.01) |
| ***C10G 35/24*** | (2006.01) |
| ***C10G 7/02*** | (2006.01) |
| *C10G 47/36* | (2006.01) |

(52) U.S. Cl.

CPC ..... *C10G 65/12* (2013.01); *C10G 7/02* (2013.01); *C10G 35/24* (2013.01); *C10G 47/36* (2013.01); *C10G 2300/1051* (2013.01); *C10G 2300/4012* (2013.01); *C10G 2400/02* (2013.01)

(58) Field of Classification Search

CPC ..... C10G 7/02; C10G 35/24; C10G 47/36; C10G 65/12; C10G 2300/1051; C10G 2300/4012; C10G 2400/02

See application file for complete search history.

(56) References Cited

U.S. PATENT DOCUMENTS

| | | | | |
|---|---|---|---|---|
| 2009/0045100 | A1* | 2/2009 | Yoon | C10G 65/10 208/59 |
| 2014/0171702 | A1* | 6/2014 | Glover | C07C 5/13 585/252 |
| 2018/0079701 | A1* | 3/2018 | Gattupalli | B01D 3/143 |

* cited by examiner

*Primary Examiner* — Brian A McCaig

(74) *Attorney, Agent, or Firm* — Paschall & Associates, LLC; James C. Paschall

(57) ABSTRACT

Process and apparatus for producing a naphtha stream is provided. The process comprises providing a kerosene stream to a hydrocracking reactor. The kerosene stream is hydrocracked in the presence of a hydrogen stream and a hydrocracking catalyst in the hydrocracking reactor at hydrocracking conditions comprising a hydrocracking pressure, a hydrocracking temperature, and a liquid hourly space velocity at a net conversion of at least about 90%, to provide a hydrocracked effluent stream comprising liquefied petroleum gas, heavy naphtha fraction and light naphtha fraction. One or more of the hydrocracking conditions are adjusted to maintain a ratio of the light naphtha fraction to the heavy naphtha fraction of at least about 2 by weight, suitably at least about 2.2 and preferably at least about 2.5 in the hydrocracked effluent stream while maintaining the net conversion of at least about 90%.

19 Claims, 2 Drawing Sheets

PROCESS FOR PRODUCING A NAPHTHA STREAM

TECHNICAL FIELD

The field of the disclosure relates to a process for producing a naphtha stream. Particularly, this disclosure is directed to a process for producing a naphtha stream for blending to obtain gasoline.

BACKGROUND

Currently, there is an increasing trend worldwide towards moving from fuel mode to petrochemical mode. Refiners are tapping every opportunity to maximize the production of petrochemicals. One among them is to utilize the comparatively less valuable hydrocarbons or distressed hydrocarbons stream to produce petrochemicals. Refiners are striving to convert this range of hydrocarbons into valuable petrochemicals.

Naphtha is primarily used as a petrochemical feedstock for running the aromatic complexes and naphtha crackers and produce more valuable petrochemical products. However, as heavy naphtha demand is increasing, refiners are looking for alternative processes to obtain heavy naphtha from less valuable hydrocarbons to produce more valuable products. Integrated refineries with petrochemical complexes are increasingly looking at value addition in terms of olefins and aromatic yields that are obtained from a barrel of crude oil.

With stringent regulation regarding emission, demand for kerosene has decreased which in turn has reduced the use of LPG as a domestic fuel. Further, kerosene finds limited application as fuel or blend, and refining kerosene alone has economic constraints. Therefore, refiners are looking for alternate use of the distressed kerosene streams.

An alternative method to convert kerosene into valuable products involves hydrocracking of kerosene to produce naphtha which can be used to produce various valuable petrochemical products such as gasoline. However, setting up a separate hydrocracking unit for kerosene to produce naphtha increases capital expenditure. Further, the percentage conversion of kerosene and the products so obtained need to meet the desired value/specifications.

Typically, a modular refinery is a refinery built from modules of refining processes and is significantly smaller in capacity than conventional or "stick-built" refineries. Modular refineries may be constructed in economically developing or economically limited locations with limited capital to construct larger capacity refineries. The modular refinery usually processes local crude sources with widely varying properties among different modular refinery sites. Therefore, a modular refinery requires a robust selection of capitally efficient technology to process feedstock with varying chemical and physical properties including kerosene. Further, due to stringent market regulations, a modular refinery needs to make major products such as gasoline within market specifications. For gasoline production to meet market specifications, streams for the gasoline pool are required to have the appropriate amount of various fractions present therein and boiling in the gasoline range. Simply blending the fractions boiling in the gasoline range including naphtha, does not result in a gasoline pool meeting the market specifications. Therefore, there is a need to provide a flexible process for preparing a gasoline pool with appropriate amount of various fractions boiling in the gasoline range and also meeting the market specifications and regulations.

Accordingly, it is desirable to provide new processes for providing cost benefits in terms of lower capital and operational expenditures. Further, there is a need for an alternative approach for gasoline production to meet market specifications. Furthermore, other desirable features and characteristics of the present subject matter will become apparent from the subsequent detailed description of the subject matter and the appended claims, taken in conjunction with the accompanying drawings and this background of the subject matter.

SUMMARY

Various embodiments contemplated herein relate to processes and apparatuses for producing a naphtha stream. The exemplary embodiments taught herein provide a process for producing a naphtha stream.

In accordance with an exemplary embodiment, a process is provided for producing a naphtha stream, the process comprises providing a kerosene stream to a hydrocracking reactor. The kerosene stream is hydrocracked in the presence of a hydrogen stream and a hydrocracking catalyst in the hydrocracking reactor at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction. One or more of the hydrocracking conditions of the hydrocracking reactor are adjusted to maintain a ratio of the light naphtha fraction to the heavy naphtha fraction of at least about 2 by weight, suitably at least about 2.2 and preferably at least about 2.5 in the hydrocracked effluent stream while maintaining the net conversion of at least about 90%. Thereafter, a naphtha stream comprising the heavy naphtha fraction and the light naphtha fraction is obtained from the hydrocracked effluent stream wherein the ratio of the light naphtha fraction to the heavy naphtha fraction of at least about 2 by weight, suitably at least about 2.2 and preferably at least about 2.5.

In accordance with another exemplary embodiment, a process for producing a naphtha stream is provided. The process comprises providing a kerosene stream to a hydrocracking reactor. In the hydrocracking reactor, the kerosene stream is hydrocracked in the presence of a hydrogen stream and a hydrocracking catalyst at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction. One or more hydrocracking conditions of the hydrocracking reactor are adjusted to maintain a yield of light naphtha fraction to vary by no more about 5% of the net hydrocracked effluent stream while maintaining the net conversion of at least about 90%. Thereafter, a naphtha stream is obtained from the hydrocracked effluent stream comprising the ratio of the light naphtha fraction to the heavy naphtha fraction of at least about 2 by weight, suitably at least about 2.2 and preferably at least about 2.5.

In accordance with yet another exemplary embodiment, a process for producing a naphtha stream is disclosed. The process for producing a naphtha stream comprises providing a kerosene stream to a hydrocracking reactor. The kerosene stream is hydrocracked in the hydrocracking reactor in the presence of a hydrogen stream and a hydrocracking catalyst at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction. One or more of the hydrocracking conditions of the hydrocracking reactor are adjusted to maintain a ratio of the light naphtha fraction to the heavy naphtha fraction of at least about 2 by weight, suitably at least about 2.2 and preferably at least about 2.5 in the hydrocracked effluent stream and to maintain a yield of the light naphtha fraction to vary by no more about 5% of the net hydrocracked effluent stream while maintaining the net conversion of at least about 90%. Thereafter, a naphtha stream comprising the heavy naphtha fraction and the light naphtha fraction is obtained wherein the ratio of the light naphtha fraction to the heavy naphtha fraction of at least about 2 by weight, suitably at least about 2.2 and preferably at least about 2.5.

In accordance with the process of the present disclosure, maintaining a ratio of the light naphtha fraction to the heavy naphtha fraction of at least about 2 by weight, suitably at least about 2.2 and preferably at least about 2.5 facilitates adjusting the gasoline pool naphtha isomerate and reformate requirements based on gasoline pool blend requirements of a target research octane rating from about 85 to about 100 and preferably about 88 to about 95. Further, maintaining the yield of light naphtha fraction to vary by no more about 5% of the hydrocracked effluent stream also assists in maintaining the ratio of the light naphtha fraction to the heavy naphtha fraction of at least about 2 by weight, suitably at least about 2.2 and preferably at least about 2.5 to meet the required gasoline pool blend octane rating. Applicants have found that varying the hydrocracking temperature in the kerosene hydrocracker resulted in cracking of heavy naphtha to liquefied petroleum gas (LPG) while keeping the amount of light naphtha to be constant. Therefore, the yield of liquefied petroleum gas increases wherein that of heavy naphtha decreases as the hydrocracking temperature varies from about 300° C. to about 425° C.

These and other features, aspects, and advantages of the present invention will become better understood upon consideration of the following detailed description, drawings and appended claims.

BRIEF DESCRIPTION OF THE DRAWINGS

For a more complete understanding of this disclosure and its features, reference is now made to the following description, taken in conjunction with the accompanying drawings, in which.

DEFINITIONS

Figure 1:
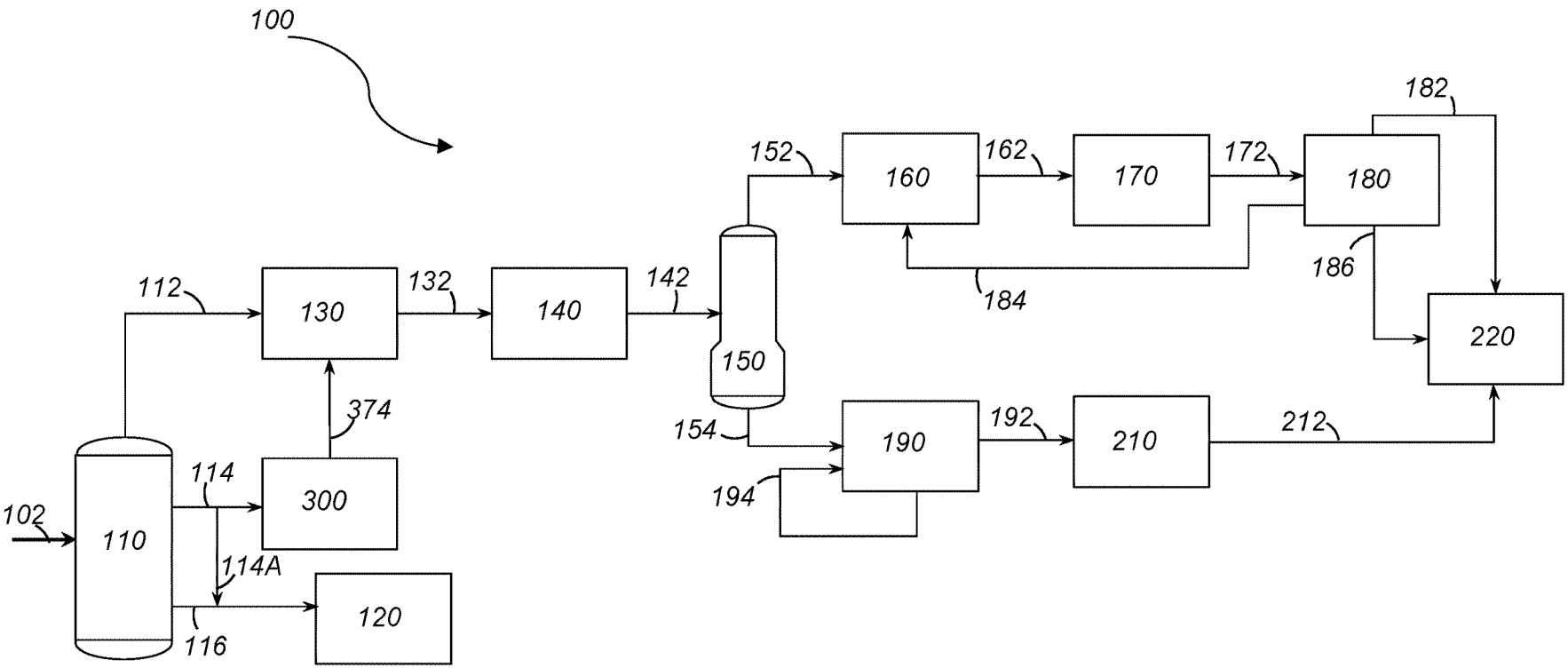
FIG. 1 illustrates a schematic diagram of a process for producing a gasoline blend in accordance with an exemplary embodiment.

As used herein, the term "stream" can include various hydrocarbon molecules and other substances.

As used herein, the term "column" means a distillation column or columns for separating one or more components of different volatilities. Unless otherwise indicated, each column includes a condenser on an overhead of the column to condense the overhead vapor and reflux a portion of an overhead stream back to the top of the column. Also included is a reboiler at a bottom of the column to vaporize and send a portion of a bottom stream back to the bottom of the column to supply fractionation energy. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column. Alternatively, a stripping stream may be used for heat input at the bottom of the column.

As used herein, the term "overhead stream" can mean a stream withdrawn in a line extending from or near a top of a vessel, such as a column.

As used herein, the term "bottoms stream" can mean a stream withdrawn in a line extending from or near a bottom of a vessel, such as a column.

As used herein, the term "predominantly" can mean an amount of generally at least about 50% or at least about 75%, preferably about 85%, and optimally about 95%, by mole, of a compound or class of compounds in a stream.

As used herein, the term "rich" can mean an amount of generally at least about 50% or at least about 70%, preferably about 90%, and optimally about 95%, by mole, of a compound or class of compounds in a stream. Broadly, the term "rich" refers to the fact an outlet stream from a column has a greater percentage of a certain component than present in the inlet feed to the column.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D-7169, ASTM D-86 or TBP, as the case may be.

As used herein, the term "final boiling point" means the temperature at which the sample has all boiled off using ASTM D-7169, ASTM D-86 or TBP, as the case may be.

As used herein, the term "T5", T50, T90 or "T95" means the temperature at which 5 volume percent, 50 volume percent, 90 volume percent or 95 volume percent, as the case may be, respectively, of the sample boils using TBP, ASTM D-2887 or ASTM D-86, as the case may be.

As used herein, the term "light naphtha" means hydrocarbons boiling in the range using the True Boiling Point distillation method of T5 between about 0° C. (32° F.) and about 34° C. (94° F.) and a T95 between about 20° C. (68° F.) to about 82° C. (180° F.).

As used herein, the term "heavy naphtha" means hydrocarbons boiling in the range using the True Boiling Point distillation method of T5 between about 20° C. (68° F.) and about 40° C. (104° F.), and T95 between about 180° C. (356° F.) and about 194° C. (380° F.).

As used herein, the term "diesel" means hydrocarbons boiling in the range using the True Boiling Point distillation method of T5 between about 150° C. (302° F.) and about 200° C. (392° F.), and T95 between about 343° C. (650° F.) and about 399° C. (750° F.).

As used herein, the term "kerosene" means hydrocarbons boiling in the range of between about 132° C. and about 300° C., using the True Boiling Point distillation method. Further, a kerosene stream may be defined as having T5 boiling point from about 120° C. to about 200° C. and T95 boiling point from about 270° C. to about 300° C. or a T10 point of no more than about 205° C. and a final boiling point of no greater than about 300° C. using ASTM D86. Furthermore, the flash point must be greater than about 38° C. using ASTM D56.

As used herein, the term "conversion" means "net conversion" and is defined as a the percentage of the reactor feed boiling above 150° C. (302° F.) converted to the reactor effluent boiling below 150° C.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator. The separator may be operated at higher pressure.

As used herein, the term "passing" includes "feeding" and "charging" and means that the material passes from a conduit or vessel to an object.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description. The Figures have been simplified by the deletion of a large number of apparatuses customarily employed in a process of this nature, such as vessel internals, temperature and pressure controls systems, flow control valves, recycle pumps, etc. which are not specifically required to illustrate the performance of the invention. Furthermore, the illustration of the process of this invention in the embodiment of a specific drawing is not intended to limit the invention to specific embodiments set out herein.

As depicted, process flow lines in the figures can be referred to, interchangeably, as, e.g., lines, pipes, branches, distributors, streams, effluents, feeds, products, portions, catalysts, withdrawals, recycles, suctions, discharges, and caustics.

An embodiment of a process for producing a naphtha stream is addressed with reference to a process and apparatus 100 according to an embodiment as shown in FIG. 1. Referring to FIG. 1, the process and apparatus 100 comprise a crude distillation unit 110, a kerosene hydrocracking unit 300, a naphtha hydrotreating unit 130, a stabilizer 140, a naphtha splitter column 150, an isomerization unit 160, a stabilizer 170, deisohexanizer 180, a reforming unit 190, a debutanizer 210, and a gasoline pool 220. As shown in FIG. 1, a hydrocarbonaceous stream may be passed to the crude distillation unit 110 to provide a kerosene stream in line 114, a diesel stream in line 116, and a naphtha stream in line 112. The kerosene stream in line 114 is passed to the kerosene hydrocracking unit 300. In the kerosene hydrocracking unit 300, the kerosene stream may be hydrocracked to produce a hydrocracked effluent stream comprising a liquefied petroleum gas (LPG), a heavy naphtha fraction, and a light naphtha fraction which is further separated as described hereinafter in detail to produce a naphtha stream in line 374 comprising the heavy naphtha fraction and the light naphtha fraction. In accordance with an exemplary embodiment, the naphtha stream comprises the ratio of the light naphtha fraction to the heavy naphtha fraction of at least about 2 by weight, suitably at least about 2.2 and preferably at least about 2.5. Nevertheless, not restricted by the crude distillation unit 110, the kerosene stream in line 114 to the kerosene hydrocracking unit 300, may originate from any external sources. Using the present flow scheme, the ratio of heavy naphtha fraction and light naphtha fraction may be varied to adjust the gasoline pool blend requirements for a target research octane rating from about 85 to about 100 and preferably about 85 to about 95. Applicants have discovered that the instant process allows adjusting the operating conditions suitably as described hereinafter in detail, to maintain the ratio of the light naphtha fraction to the heavy naphtha fraction of at least about 2 by weight, suitably at least about 2.2 and preferably at least about 2.5 along with a predetermined conversion rate and a predetermined yield.

In accordance with the process of the present disclosure, one or more of the hydrocracking conditions may be adjusted to maintain a ratio of the light naphtha fraction to the heavy naphtha fraction of at least about 2 by weight, suitably at least about 2.2 and preferably at least about 2.5 in the hydrocracked effluent stream while maintaining the net conversion of at least about 90%.

In an embodiment, varying one or more of the hydrocracking conditions comprises varying the hydrocracking temperature from about 300° C. to about 425° C. to maintain a ratio of the light naphtha fraction to the heavy naphtha fraction of at least about 2 by weight, suitably at least about 2.2 and preferably at least about 2.5 in the hydrocracked effluent stream while maintaining the net conversion of at least about 90%. In another exemplary embodiment, adjusting the one or more of the hydrocracking conditions comprises varying LHSV from about 1 $hr^{-1}$ to about 4 $hr^{-1}$ to maintain a ratio of the light naphtha fraction to the heavy naphtha fraction of at least about 2 by weight, suitably at least about 2.2 and preferably at least about 2.5 in the hydrocracked effluent stream while maintaining the net conversion of at least about 90%. In embodiments, LHSV may be varied by varying a feed rate of the kerosene stream to the hydrocracking unit 300. LHSV to the hydrocracking unit 300 may be varied by various way comprising varying the feed rate of hydrocarbonaceous stream in line 102 to the crude distillation unit 110 or varying the operating conditions of the crude distillation unit 110 to produce a kerosene stream with a wider boiling point interval in line 114. Further, a kerosene stream from an external source may also be passed to the hydrocracking unit along with the kerosene stream in line 114 to vary LHSV. As shown in FIG. 1, the feed rate of the kerosene stream may be varied by bypassing a portion of the kerosene stream in line 114A around the kerosene hydrocracking unit 300. In an aspect, the feed rate of the kerosene stream to the hydrocracking reactor 320 in FIG. 2 may be varied by bypassing a portion of the kerosene stream in line 114A around the kerosene hydrocracking unit 300 to a diesel hydrotreating unit 120. The bypassed kerosene stream in line 114A may be hydrotreated with diesel in the diesel hydrotreating unit 120. The kerosene stream in line 114 meets the jet fuel specification therefore, a portion of the kerosene stream may be passed to jet fuel pool. Accordingly, the bypassed kerosene stream in line 114A may be passed to a jet fuel pool for further blending or storage.

Referring back to FIG. 1, at least a portion of the naphtha stream in line 374 may be passed to a naphtha treatment unit 130 comprising a hydrotreating reactor or a sulfur guard bed prior to splitting the at least portion of the naphtha stream. The guard bed in the naphtha treatment unit 130 can include an adsorbent material to remove contaminants like mercaptan or thiophenic sulfur. The guard bed in the naphtha treatment unit 130 may include a fixed bed that includes the adsorbent material. At least a portion of the naphtha stream in line 374 may be contacted with the adsorbent material in the guard bed in the naphtha treatment unit 130 to produce a treated or desulfurized naphtha stream. Additionally, a naphtha stream from external sources may also be passed to the naphtha hydrotreating reactor or the guard bed in the naphtha treatment unit 130 along with naphtha stream in line 374 to provide a treated naphtha stream in line 132. As shown, the naphtha stream in line 112 from the overhead of the crude distillation unit 110 may also be passed to the naphtha hydrotreating reactor or the guard bed in the naphtha treatment unit 130. Additionally, a naphtha stream from an external source may also be passed to the naphtha hydrotreating reactor or the guard bed in the naphtha treatment unit 130. Although not shown in FIG. 1, the naphtha stream in line 374 and the naphtha stream in line 112 may be combined and thereafter the combined stream may be passed to the naphtha hydrotreating reactor or the guard bed in the naphtha treatment unit 130 to provide a treated naphtha stream in line 132. The hydrotreating reactor or the guard bed in the naphtha treatment unit 130, provides for the removal of sulfur and/or nitrogen from the naphtha stream in the presence of a hydrotreating catalyst to provide the treated naphtha stream in line 132.

The treated naphtha stream in line 132 may be passed to a stabilizer 140 to remove unreacted hydrogen and lighter components present therein such as hydrogen sulfide and to provide a stabilized naphtha stream in line 142. The concentration of impurities including sulfur compounds present in the stabilized naphtha stream in line 142 is less than about 1 mass ppm.

At least a portion of the stabilized naphtha stream in line 142 may be passed to the naphtha splitter column 150 to split the naphtha stream in to the light naphtha fraction comprising predominantly $C_5$'s and $C_6$'s and the heavy naphtha fraction comprising $C_6$ to $C_{11}$ paraffins, naphthenes, and aromatics. The light naphtha fraction may be obtained from the overhead of the naphtha splitter column in line 152 and the heavy naphtha fraction may be obtained from the bottom of the naphtha splitter column in line 154.

The light naphtha fraction in line 152 comprises linear paraffins and therefore need to be upgraded to increase their octane value. At least a portion of the light naphtha fraction in line 152 may be passed to an isomerization unit 160 to isomerize at least a portion of the light naphtha fraction in the isomerization unit operating under isomerization conditions to produce a light naphtha isomerate stream in line 162. In an alternate scheme, a light naphtha stream from other sources may also be isomerized in the isomerization unit 160 along with the light naphtha fraction in line 152. In an exemplary embodiment, the isomerization conditions comprise an isomerization temperature from about 40° C. to about 250° C. and an isomerization pressure from about 100 kPa (g) to about 10000 kPa (g). Any catalyst suitable for the isomerization of at least a portion of the light naphtha fraction may be used as an isomerization catalyst in the isomerization unit 160. One suitable isomerization catalyst comprises a platinum-group metal, hydrogen-form crystalline aluminosilicate and a refractory inorganic oxide. Also, the isomerization catalyst may be chloride alumina in embodiments, or zirconia-containing catalyst in other embodiments. Although not shown in FIG. 1, a make-up hydrogen stream may be passed to the isomerization unit 160. Further, at least a portion of the light naphtha fraction in line 152 and the make-up hydrogen stream may be combined and then passed to the isomerization unit 160. In isomerization unit 160, the $C_5$ and $C_6$ paraffins present in the light naphtha fraction get isomerized to branched structures having higher octane number in the presence of the isomerization catalyst under isomerization conditions. The light naphtha isomerate stream from the isomerization unit 160 may be cooled and then sent to a product separator where the recycle hydrogen is separated from the light naphtha isomerate stream. The recycle hydrogen may be used in the process further.

The light naphtha isomerate stream comprising branched hydrocarbons in line 162 may be passed to a stabilizer 170 to remove the light ends and dissolved hydrogen present therein and provide a stabilized isomerized stream comprising branched hydrocarbons in line 172.

As shown, the light naphtha isomerate stream in line 162 from the isomerization unit 160 may be passed directly to the stabilizer 170 to provide the stabilized isomerized stream in a bottoms line 172. The stabilized isomerized stream in the bottoms line 172 comprising branched hydrocarbons may be passed to a deisohexanizer 180 to separate a deisohexanizer side draw stream in line 184 comprising linear hexane, cyclic hydrocarbons, and monomethyl-branched pentane present therein to provide a light naphtha isomerate product. In the deisohexanizer 180, the light naphtha isomerate product comprising isopentane, 2,2-dimethylbutane, and 2,3-dimethylbutane may be separated in an overhead stream in line 182. Also, a bottoms stream comprising $C_6$ naphthenes and $C_7$'s, may be removed in line 186 from the deisohexanizer bottom. The side draw stream in line 184 comprising linear hexane, cyclic hydrocarbons, and monomethyl-branched pentane may be recycled to the isomerization unit 160 for further isomerization of any $C_5$ and $C_6$ paraffins present therein or it may be separated for further use. The light naphtha isomerate product from the overhead stream in line 182 may be passed to the gasoline pool 220 for blending. As shown, the bottoms stream in line 186 comprising $C_6$ naphthenes and $C_7$'s, may also be passed to the gasoline pool 220 for blending.

Referring back to the naphtha splitter column 150, a heavy naphtha fraction in a bottoms line 154 comprises $C_6$ to $C_{11}$ paraffins, naphthenes, and aromatics. To provide a gasoline blending component, the paraffins and the naphthenes present in the heavy naphtha fraction need to be converted in to aromatics owing to high-octane values of the aromatics compared to paraffins and naphthenes. Accordingly, at least a portion of the heavy naphtha fraction may be subjected to reforming to provide a heavy naphtha reformate product. As shown in FIG. 1, the heavy naphtha fraction in the bottoms line 154 may be passed to a reforming unit 190 operating under reforming conditions thereby reforming at least a portion of the heavy naphtha fraction to produce a heavy naphtha reformate stream in line 192. In an alternate scheme, a heavy naphtha fraction/stream from other sources may also be passed to the reforming unit 190 along with the heavy naphtha fraction in the bottoms line 154. A recycled hydrogen stream in line 156 may also be passed to the reforming unit 190. Further, at least a portion of the heavy naphtha fraction in the bottoms line 154 and the recycled hydrogen stream in line 194 may be combined and then passed to the reforming unit 190.

In the reforming unit 190, the heavy naphtha fraction is contacted with a reforming catalyst, comprising a supported platinum-group metal component, at reforming conditions comprising a reforming temperature of from 260° C. to 560° C. and a reforming pressure from about 100 kPa (g) to about 2000 kPa (g) to reform at least a portion of the heavy naphtha fraction and to produce a heavy naphtha reformate stream in line 192. Reforming catalysts generally comprise a metal on a support. The support can include a porous material, such as an inorganic oxide or a molecular sieve, and a binder with a weight ratio from 1:99 to 99:1. The weight ratio is preferably from 1:9 to 9:1. Inorganic oxides used for support include, but are not limited to, alumina, magnesia, titania, zirconia, chromia, zinc oxide, thoria, boria, ceramic, porcelain, bauxite, silica, silica-alumina, silicon carbide, clays, crystalline zeolitic aluminosilicates, and mixtures thereof. Porous materials and binders are known in the art and are not presented in detail here. The metals preferably are one or more Group VIII noble metals, and include platinum, iridium, rhodium, and palladium. Typically, the catalyst contains an amount of the metal from 0.01% to 2% by weight, based on the total weight of the catalyst. The catalyst can also include a promoter element from Group IIIA or Group IVA. These metals include gallium, germanium, indium, tin, thallium and lead. The heavy naphtha reformate stream in line 192 comprises high-octane liquid product rich in aromatics. Along with high-octane liquid product, hydrogen gas and light gases are also produced as reaction by-products in the reforming unit 190. The hydrogen gas may be removed from the reforming unit 190 and a portion of the hydrogen gas may be passed to the reforming unit 190 as the recycled hydrogen stream in line 194. Further, the remaining portion of the hydrogen gas may be compressed and used elsewhere in the process 100 or can be stored. The heavy naphtha reformate stream in line 192 may be passed to a debutanizer 210 to strip off the light end hydrocarbons to provide the heavy naphtha reformate product in line 212. In the debutanizer 210, $C_3$ and $C_4$ are stripped off as an overhead stream, leaving the heavy naphtha reformate as a bottoms product from the debutanizer 210 in an overhead line 212.

Thereafter, the light naphtha isomerate product stream comprising isopentane, 2,2-dimethylbutane, and 2,3-dimethylbutane, in line 182 and heavy naphtha reformate product stream in the overhead line 212 may be passed to the gasoline pool 220 and blended to obtain gasoline having a predetermined target research octane rating. In an embodiment, the light naphtha isomerate product and the heavy naphtha isomerate product are blended to obtain gasoline having a target research octane rating from about 85 to about 100 and preferably about 85 to about 95 and a ratio of the light naphtha fraction to the heavy naphtha fraction of at least about 2 by weight, suitably at least about 2.2 and preferably at least about 2.5. In another embodiment, the light naphtha isomerate product stream and the heavy naphtha reformate product stream are blended in a ratio from about 0.7:1 to about 1.3:1 to obtain gasoline having a target research octane rating from about 85 to about 100 and preferably about 85 to about 95.

Figure 2:
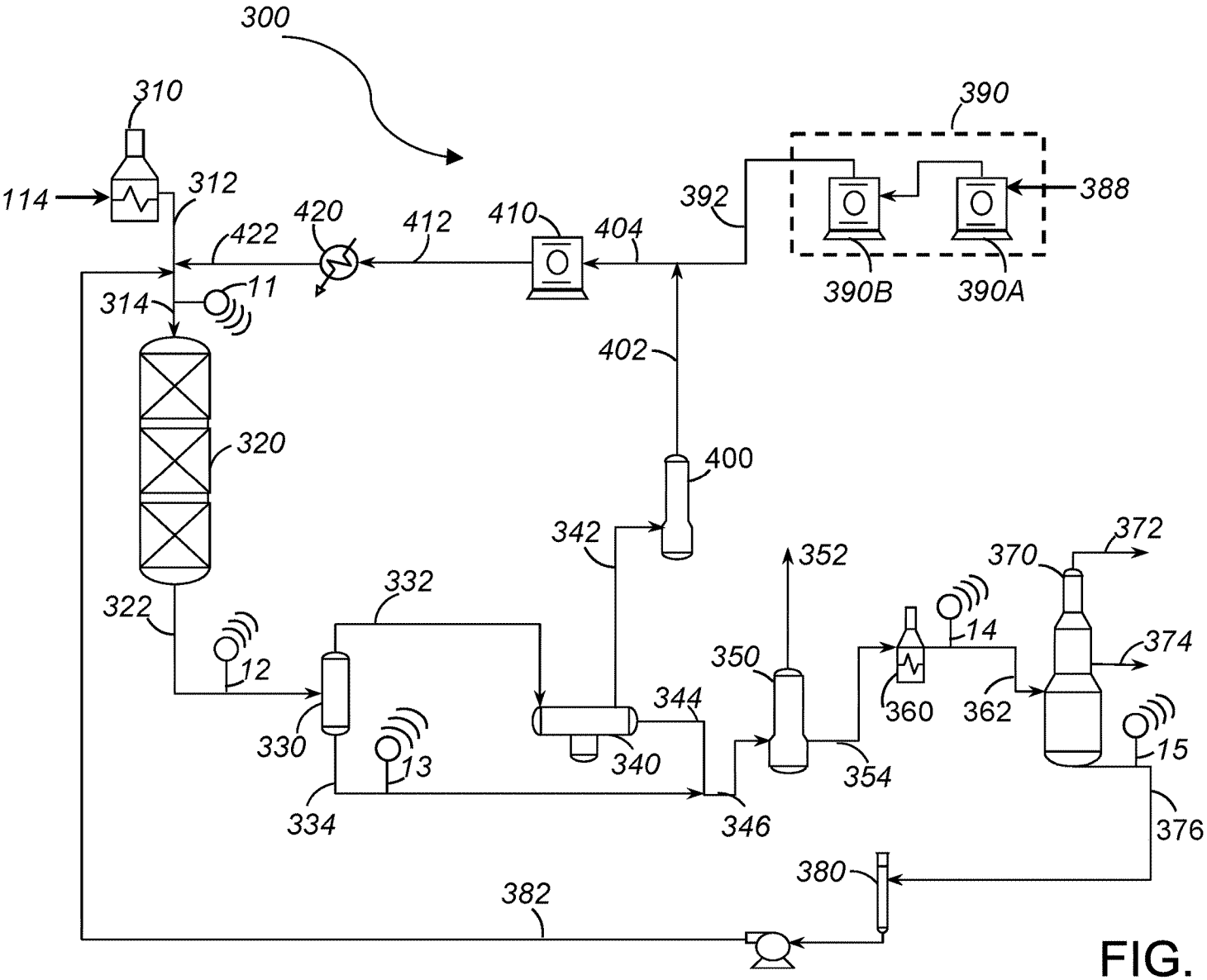
FIG. 2 illustrates a schematic diagram of a process for hydrocracking a kerosene stream in accordance with the process in accordance with an exemplary embodiment.

Further, the hydrocracking of the kerosene stream is addressed with reference to a process and apparatus 300 according to an exemplary embodiment as shown in FIG. 2. Referring to FIG. 2, the process and apparatus 300 comprise a pre-heater 310, a hydrocracking reactor 320, a first separator 330, a cold separator 340, a stripping column 350, a fractionation column 370, a make-up gas compressor 390, and a recycle gas compressor 410. As shown in FIG. 2, the kerosene stream in line 114 may be passed to the pre-heater 310 to provide a pre-heated kerosene stream in line 312. Thereafter, the pre-heated kerosene stream in line 312 may be passed to the hydrocracking reactor 320. The pre-heater 310 is optionally used to adjust the total reactants inlet temperature to the hydrocracking reactor. In various embodiments, the kerosene stream in line 114 may be passed directly to the hydrocracking reactor 320. The pre-heated kerosene stream in line 312 may be combined with a hydrogen-rich stream in line 422 and a recycle kerosene stream in line 382 as described hereinafter in detail, to provide a combined stream in line 314. The combined stream in line 314 may be passed to the hydrocracking reactor 320 comprising one or more hydrocracking catalyst beds. Although not shown in FIG. 2, the pre-heated kerosene stream in line 312, the hydrogen-rich stream in line 422, and the recycle kerosene stream in line 382 may be passed separately to the hydrocracking reactor 320. In hydrocracking reactor 320, the kerosene stream is hydrocracked in the presence of a hydrogen stream and a hydrocracking catalyst at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction. The hydrocracked effluent stream comprising liquefied petroleum gas (LPG), heavy naphtha fraction and light naphtha fraction is removed from the bottom of the hydrocracking reactor in line 322. In an exemplary embodiment, the hydrocracking conditions of the hydrocracking reactor 320 may comprise a hydrogen pressure from about 2757 kPa(g) (400 psig) to about 5515 kPa(g) (800 psig).

The hydrocracking reactor 320 may comprise one or more beds of hydrocracking catalyst to provide the hydrocracked effluent stream in line 322. Each of the hydrocracking catalyst beds of the hydrocracking reactor 320 may comprise similar or different catalyst compared to the other beds of the hydrocracking reactor 320. The catalyst beds of the hydrocracking reactor 320 may comprise any suitable catalyst including but not limited to catalysts that comprise amorphous silica-alumina or zeolite in the catalyst bases combined with one or more Group VIII or Group VIB metal hydrogenating components. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms. Zeolites having a relatively high silica/alumina mole ratio between about 3 and about 12 may be employed. Suitable zeolites found in nature include, for example, mordenite, stilbite, heulandite, ferrierite, dachiardite, chabazite, erionite and faujasite. Suitable synthetic zeolites include, for example, the beta, B, X, Y and L crystal types, e.g., synthetic faujasite and mordenite. The preferred zeolites are those having crystal pore diameters between about 8-12 Angstroms, wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Zeolites, such as Y zeolites may be steamed and acid washed to dealuminate the zeolite structure.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 35 percent by weight may be used. In the case of the noble metals, it is normally preferred to use about 0.05 to about 2 wt-%.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt-%. These diluents may be employed as such or they may contain a minor proportion of an added hydrogenating metal such as a Group VIB and/or Group VIII metal. Additional metal promoted hydrocracking catalysts may also be utilized in the process of the present invention which comprise, for example, aluminophosphate molecular sieves, crystalline chromosilicates and other crystalline silicates.

The hydrocracking catalyst preferably has high activity such as comprising at least about 40 to about 80 wt-% dealuminated Y zeolite or at least about 15 to about 35 wt-% non-dealuminated Y zeolite or at least about 3 to about 10 wt-% beta zeolite, or some combination thereof yielding similar activity. In each case, mass-transfer limitations are expected to be significant and thus smaller-diameter extrudates such as 1/16 inch cylinders or 1/16 inch trilobes may give the best performance. However, larger-diameter extrudates such as 1/16 inch cylinders or 1/16 inch trilobes may also be used. In another embodiment, hydrocracking catalysts may be of larger 1/8" size with lobe shapes beneficial for reducing diffusion such as trilobes or quadralobes. The hydrocracking catalyst beds of the hydrocracking reactor 320 may comprise about 30 to about 100% or up to about 60% of the total catalyst volume in the hydrocracking reactor 320.

In accordance with the process of the present disclosure, one or more of the hydrocracking conditions may be adjusted to maintain a ratio of the light naphtha fraction to the heavy naphtha fraction of at least about 2 by weight, suitably at least about 2.2 and preferably at least about 2.5 in the hydrocracked effluent stream while maintaining the net conversion of at least about 90%.

In an exemplary embodiment, adjusting the one or more of the hydrocracking conditions comprises varying the hydrocracking temperature from about 300° C. to about 425° C. to maintain a ratio of the light naphtha fraction to the heavy naphtha fraction of at least about 2 by weight, suitably at least about 2.2 and preferably at least about 2.5 in the hydrocracked effluent stream while maintaining the net conversion of at least about 90%.

In accordance with an exemplary embodiment, LHSV may be varied by varying a feed rate of the kerosene stream in line 312 to the hydrocracking reactor 320 and subsequently varying the combined stream in line 314 to the hydrocracking reactor 320.

In an aspect, the one or more of the hydrocracking conditions of the hydrocracking reactor 320 are adjusted to maintain the yield of light naphtha fraction to vary by no more about 5%, or no more than 2%, of the net hydrocracking effluent stream.

At least a portion of the hydrocracked effluent stream in line 322 may be fractioned in a fractionation column to obtain a naphtha stream comprising the ratio of the light naphtha fraction to the heavy naphtha fraction of at least about 2 by weight, suitably at least about 2.2 and preferably at least about 2.5. As shown in FIG. 2, the hydrocracked effluent stream in line 322 may be passed to a first separator 330 to separate the hydrocracked effluent stream in to a first vaporous stream in line 332 and a first liquid stream in line 334. In an aspect, the first separator 330 may be in direct communication with the hydrocracking reactor 320 via the hydrocracked effluent stream in line 322. Accordingly, the hydrocracked effluent stream in line 322 may be passed directly to the first separator 330. In various embodiments, the first separator is a hot separator 330. Suitable operating conditions of the hot separator 330 include, for example, a temperature of about 260° C. to 320° C. The hot separator 330 may be operated at a slightly lower pressure than the first hydrocracking reactor 320 accounting for pressure drop of intervening equipment. Although not shown, the hot separator may have a corresponding flash drum and the first liquid stream in line 334 may be let down in pressure and flashed in the hot flash drum.

The first vaporous stream in line 332 may be passed to a cold separator 340 to further separate the first vaporous stream into a vapor fraction in line 342 and a liquid fraction in line 344. Suitable operating conditions of the cold separator 340 include, for example, a temperature of about 20° C. to 60° C. and below the pressure of the hydrocracking reactor and the hot separator dependent on the pressure drop of the system between the hot separator and cold separator due to equipment such as piping and heat exchangers. In another aspect, the cold separator 340 may be in direct communication with the hydrocracking reactor 320 via the hydrocracked effluent stream in line 322. Although not shown, the cold separator may have a corresponding flash drum and the liquid fraction in line 344 may be let down in pressure and flashed in the cold flash drum.

The liquid fraction in line 344 and the first liquid stream in line 334 may be passed to a stripper 350 to further separate the vapors and/or gases present therein in line 352. In an alternate scheme, the liquid fraction in line 344 may be combined with the first liquid stream in line 334 to provide a combined liquid stream in line 346 and passing the combined liquid stream in line 346 to the stripper 350. Any suitable stripping media can be used in the stripper 350 to separate the remaining vapors and/or gases and to provide a stripped liquid stream in line 354. Preferably, the stripping media is steam. In an exemplary embodiment, the liquid fraction in line 344 and the first liquid stream in line 334 may be reboiled to separate the remaining vapors and/or gases and to provide a stripped liquid stream in line 354. Further, the vapor fraction in line 342 may be sent to a scrubber 400 for removal of acid gases to provide a hydrogen rich gaseous stream in line 402 which is recycled to the hydrocracking reactor 320. Use of the scrubber 400 is optional and the vapor fraction in line 342 may be recycled to the hydrocracking reactor 320 directly.

Thereafter, the stripped liquid stream in line 354 may be passed to a pre-heater 360 to heat the stripped liquid stream to a predetermined temperature before passing to the fractionation column 370 in line 362 to fractionate the stripped liquid stream into various fractions based on their boiling range including but not limited to a LPG stream, a naphtha stream comprising the heavy naphtha fraction and the light naphtha fraction, a side cut stream comprising kerosene, and an unconverted kerosene stream. In an aspect, stripped liquid stream in line 354 may be sent directly to the fractionation column 370. As shown, the LPG stream is withdrawn in an overhead line 372, the naphtha stream is withdrawn in a side line 374, and the unconverted kerosene stream is withdrawn in recycle kerosene stream bottoms line 376. The naphtha stream in line 374 comprises the ratio of the light naphtha fraction to the heavy naphtha fraction of at least about 2 by weight, suitably at least about 2.2 and preferably at least about 2.5.

In an exemplary embodiment as shown in FIG. 2, the recycle kerosene stream bottoms line 376 may be passed to a recycle stripper 380 to provide a stripped kerosene fraction in line 382. As shown, at least a portion of the stripped kerosene stream in line 382 may be passed back to the hydrocracking reactor 320 as recycle kerosene stream for further hydrocracking. Nonetheless, the recycle kerosene stream bottoms line 376 may be recycled to the hydrocracking reactor 320 directly.

Further, as shown in FIG. 2, a compression system 390 is provided to compress a make-up hydrogen stream in line 388. The compression system 300 may be a multistage compression system comprising at least two compressors. In an exemplary embodiment as shown in FIG. 2, the compression system 390 of the process of the present disclosure comprises two compressors a first compressor 390A, and a second compressor 390B. The compression system 390 may compress the make-up hydrogen stream in line 388 to provide a compressed make-up hydrogen stream in line 392. The compressed hydrogen stream in line 392 may be combined with the hydrogen rich gaseous stream in line 402 to provide a make-up hydrogen stream to the first hydrocracking reactor 320 via line 404. In another exemplary embodiment, make-up hydrogen stream in line 404 may be passed to a recycle compressor 410 to compress the make-up hydrogen stream in line 404. However, the hydrogen rich gaseous stream in line 402 may be first passed to the recycle compressor 410 to provide a compressed make-up hydrogen stream in line 412 and thereafter combined with the make-up hydrogen stream in line 392. As shown, a compressed make-up hydrogen stream in line 412 may be passed to a heat exchanger [420 to heat up the compressed make-up hydrogen stream to a predetermined temperature and passed to the hydrocracking reactor 320 as the hydrogen-rich stream in line in line 422. The heat exchanger 420 is optionally used to reduce the heat load on the heater 310. And, compressed make-up hydrogen stream in line 412 may be passed directly to the hydrocracking reactor 320 as the hydrogen-rich stream. Further, the heat exchanger 420 can be any suitable heat exchanger or a plurality of heat exchanger for heating the compressed make-up hydrogen stream in line 412. Although not shown in FIG. 1, the recycle kerosene stream in line 114 and the hydrogen-rich stream in line 412 may be combined, preheated in the heat exchanger 420 and further heated in the pre-heater 310 to a required hydrocracking reactor inlet temperature.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect. Further, the figure shows one or more exemplary sensors such as 11, 12, 13, 14 and 15 located on or more conduits. Nevertheless, there may be sensors present on every stream to control the corresponding parameter(s) accordingly.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein. For example, in the present flow-scheme, one or more sensors may be used to measure the ratio of the heavy naphtha fraction to the light naphtha in the hydrocracking effluent stream. Simultaneously, the severity of the hydrocracking reactor may be controlled by adjusting the hydrocracking temperature, the feed rate, etc. to maintain a ratio of the light naphtha fraction to the heavy naphtha fraction of at least about 2 by weight, suitably at least about 2.2 and preferably at least about 2.5. For example, an adjustment may need to be made if a different feed stream replaces a former feed stream to the crude distillation unit 110 in line 102.

Applicants have found that using the proposed flow scheme enables the variation of heavy naphtha fraction and light naphtha fraction present in the naphtha stream from the hydrocracking unit. Using the present flow scheme, the ratio of heavy naphtha fraction and light naphtha fraction can be varied to adjust the gasoline pool naphtha isomerate and reformate requirements as per the gasoline pool blend requirements of a target research octane rating from about 85 to about 100 and preferably about 85 to about 95.

Further, varying the hydrocracking temperature from about 300° C. to 425° C. facilitates maintaining the ratio of the light naphtha fraction to the heavy naphtha fraction of at least about 2 by weight, suitably at least about 2.2 and preferably at least about 2.5 in the hydrocracking effluent stream while maintaining the net conversion of at least about 90%. Operating the hydrocracking reactor under this temperature range provides a net conversion rate of at least about 90% while maintaining the ratio of the light naphtha fraction to the heavy naphtha fraction of at least about 2 by weight, suitably at least about 2.2 and preferably at least about 2.5. Also, maintaining the yield of the yield of light naphtha fraction to vary by no more about 5% of the hydrocracked effluent stream assists in maintaining the ratio of the light naphtha fraction to the heavy naphtha fraction of at least about 2 by weight, suitably at least about 2.2 and preferably at least about 2.5 to meet the required gasoline pool blend octane rating.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

EXAMPLES

In the following examples, a kerosene stream with physical and chemical properties in Table 1 was processed at 5.5 MPa (g) (800 psig) pressure and 1.9 hydrocracking catalyst liquid hourly space velocity using HC-150 hydrocracking catalyst that is available from UOP Honeywell. The resultant net conversion and product yields of liquefied petroleum gas (LPG), light naphtha comprising pentanes and hexanes, and heavy naphtha comprising heptanes and heavier hydrocarbons boiling up to 150° C. (302° F.) are shown in the Table 2.

TABLE 1

| Kerosene Stream Properties | |
|---|---|
| API Gravity, ° API | 48.2 |
| Specific Gravity (16° C./16° C.) | 0.787 |
| Sulfur, wt % | <0.5 |
| Nitrogen, wppm | <100 |
| ASTM D 2887 T5, ° C. (° F.) | 142 (288) |
| ASTM D 2887 T50, ° C. (° F.) | 193 (380) |
| ASTM D 2887 T95, ° C. (° F.) | 240 (464) |

Example 1 was conducted outside the aforementioned described conditions of the invention. In Example 1, the net conversion was less than 90 net weight percent conversion to product boiling below 150° C. (302° F.) and the resultant light naphtha to heavy naphtha ratio was 1.4. Example 2 was conducted within the aforementioned described conditions of the invention. In Example 2, the net conversion was greater than 90 weight percent to product boiling below 150° C. (302° F.) and the net conversion was achieved by increasing the reactor average bed temperature (ABT) to higher than in Example 1. The resultant weight ratio of light naphtha to heavy naphtha was 2.5.

TABLE 2

| Example | 1 | 2 |
|---|---|---|
| ABT, ° F. | 640 | 655 |
| Yields, wt % | | |
| $C_3$-$C_4$ LPG | 11.4 | 26.9 |
| $C_5$-$C_6$ Light Naphtha | 44.4 | 52.2 |
| $C_7$-150° C. (302° F.) Heavy Naphtha | 32.5 | 20.9 |

TABLE 2-continued

| Example | 1 | 2 |
|---|---|---|
| 150° C. (302° F.) + Unconverted Kerosene | 14.0 | 3.0 |
| Kerosene Net Conversion, wt % | 85 | 97 |
| Weight Ratio of Light Naphtha to Heavy Naphtha, wt/wt | 1.4 | 2.5 |

SPECIFIC EMBODIMENTS

While the following is described in conjunction with specific embodiments, it will be understood that this description is intended to illustrate and not limit the scope of the preceding description and the appended claims.

A first embodiment of the invention is a process for producing a naphtha stream comprising providing a kerosene stream to a hydrocracking reactor; hydrocracking the kerosene stream in the presence of a hydrogen stream and a hydrocracking catalyst in the hydrocracking reactor at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction; adjusting one or more of the hydrocracking conditions to maintain a ratio of the light naphtha fraction to the heavy naphtha fraction of at least about 2 by weight, suitably at least about 2.2 and preferably at least about 2.5 in the hydrocracked effluent stream while maintaining the net conversion of at least about 90%; and obtaining a naphtha stream comprising the ratio of the light naphtha fraction to the heavy naphtha fraction of at least about 2 by weight, suitably at least about 2.2 and preferably at least about 2.5 from the hydrocracking effluent stream. An embodiment of the invention is one, any or all of prior embodiments in this paragraph up through the first embodiment in this paragraph further comprising splitting at least a portion of the naphtha stream in a naphtha splitter column to provide the light naphtha fraction and the heavy naphtha fraction; isomerizing the light naphtha fraction to provide a light naphtha isomerate product; reforming the heavy naphtha fraction to provide a heavy naphtha reformate product; and blending the light naphtha isomerate product and the heavy naphtha reformate product to obtain gasoline having a target research octane rating from about 90 to about 105. An embodiment of the invention is one, any or all of prior embodiments in this paragraph up through the first embodiment in this paragraph further comprising passing the naphtha stream to a naphtha hydrotreating reactor or a guard bed to provide a hydrotreated effluent stream prior to splitting the portion of naphtha stream. An embodiment of the invention is one, any or all of prior embodiments in this paragraph up through the first embodiment in this paragraph, wherein adjusting the one or more of the hydrocracking conditions comprises varying the hydrocracking temperature from about 300° C. to about 425° C. An embodiment of the invention is one, any or all of prior embodiments in this paragraph up through the first embodiment in this paragraph, wherein adjusting the one or more of the hydrocracking conditions comprises varying the LHSV from about 1 hr-1 to about 4 hr-1. An embodiment of the invention is one, any or all of prior embodiments in this paragraph up through the first embodiment in this paragraph, wherein the LHSV is varied by varying a feed rate of the kerosene stream to the hydrocracking reactor. An embodiment of the invention is one, any or all of prior embodiments in this paragraph up through the first embodiment in this paragraph, wherein the feed rate is varied by bypassing a portion of the kerosene stream around the kerosene hydrocracking reactor. An embodiment of the invention is one, any or all of prior embodiments in this paragraph up through the first embodiment in this paragraph further comprising adjusting the one or more hydrocracking conditions to maintain a yield of the light naphtha fraction to vary by no more about 5% of the net hydrocracked effluent stream. An embodiment of the invention is one, any or all of prior embodiments in this paragraph up through the first embodiment in this paragraph, wherein the hydrocracking conditions comprise a hydrogen pressure from about 2757 kPa(g) (400 psig) to about 5515 kPa(g) (800 psig). An embodiment of the invention is one, any or all of prior embodiments in this paragraph up through the first embodiment in this paragraph, wherein the step of isomerizing the light naphtha fraction comprises a) isomerizing at least a portion of the light naphtha fraction in an isomerization unit operating under isomerization conditions to produce a light naphtha isomerate stream; b) passing the light naphtha isomerate stream to a stabilizer to provide a stabilized isomerized stream comprising branched hydrocarbons; and c) passing the stabilized isomerized stream to a deisohexanizer to separate a deisohexanizer recycle stream comprising linear hexane, cyclic hydrocarbons, and monomethyl-branched pentane to provide the light naphtha isomerate product. An embodiment of the invention is one, any or all of prior embodiments in this paragraph up through the first embodiment in this paragraph, wherein the step of reforming the heavy naphtha fraction comprises a) reforming at least a portion of the heavy naphtha fraction in a reforming unit operating under reforming conditions to produce a heavy naphtha reformate stream; and b) passing the heavy naphtha reformate stream to a debutanizer to strip off the light end hydrocarbons to provide the heavy naphtha reformate product. An embodiment of the invention is one, any or all of prior embodiments in this paragraph up through the first embodiment in this paragraph, wherein the isomerization conditions comprise an isomerization temperature from about 40° C. to about 250° C. and an isomerization pressure from about 100 kPa(g) to about 10000 kPa(g). An embodiment of the invention is one, any or all of prior embodiments in this paragraph up through the first embodiment in this paragraph, wherein the reforming conditions comprise a reforming temperature from about 260° C. to about 560° C. and a reforming pressure from about 100 kPa(g) to about 2000 kPa(g). An embodiment of the invention is one, any or all of prior embodiments in this paragraph up through the first embodiment in this paragraph, wherein the step of the obtaining the naphtha stream comprises fractionating the hydrocracked effluent stream to provide the naphtha stream. An embodiment of the invention is one, any or all of prior embodiments in this paragraph up through the first embodiment in this paragraph, further comprising at least one of sensing at least one parameter of the process for producing a naphtha stream and generating a signal or data from the sensing; generating and transmitting a signal; or generating and transmitting data.

A second embodiment of the invention is a process for producing a naphtha stream comprising providing a kerosene stream to a hydrocracking reactor; hydrocracking the kerosene stream in the presence of a hydrogen stream and a hydrocracking catalyst in the hydrocracking reactor at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction; adjusting the one or more hydrocracking conditions to maintain a yield of the light naphtha fraction to vary by no more about 5% of the net hydrocracked effluent stream while maintaining the net conversion of at least about 90%; and obtaining a naphtha stream comprising a ratio of the light naphtha fraction to the heavy naphtha fraction of at least about 2 by weight, suitably at least about 2.2 and preferably at least about 2.5 from the hydrocracked effluent stream. An embodiment of the invention is one, any or all of prior embodiments in this paragraph up through the second embodiment in this paragraph, wherein adjusting the one or more of the hydrocracking conditions comprises varying the hydrocracking temperature from about 300° C. to about 425° C. An embodiment of the invention is one, any or all of prior embodiments in this paragraph up through the second embodiment in this paragraph, wherein adjusting the one or more of the hydrocracking conditions comprises varying the LHSV from about 1 hr-1 to about 4 hr-1. An embodiment of the invention is one, any or all of prior embodiments in this paragraph up through the second embodiment in this paragraph, wherein the LHSV is varied by varying a feed rate of the kerosene stream to the hydrocracking reactor. An embodiment of the invention is one, any or all of prior embodiments in this paragraph up through the second embodiment in this paragraph, wherein the feed rate is varied by bypassing a portion of the kerosene stream around the kerosene hydrocracking reactor.

A third embodiment of the invention is a process for producing a naphtha stream comprising providing a kerosene stream to a hydrocracking reactor; hydrocracking the kerosene stream in the presence of a hydrogen stream and a hydrocracking catalyst in the hydrocracking reactor at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction; adjusting one or more of the hydrocracking conditions to maintain a ratio of the light naphtha fraction to the heavy naphtha fraction of at least about 2 by weight, suitably at least about 2.2 and preferably at least about 2.5 in the hydrocracked effluent stream and maintain a yield of the light naphtha fraction to vary by no more about 5% of the net hydrocracked effluent stream while maintaining the net conversion of at least about 90%; and obtaining a naphtha stream comprising the ratio of the light naphtha fraction to the heavy naphtha fraction of at least about 2 by weight, suitably at least about 2.2 and preferably at least about 2.5 from the hydrocracked effluent stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

The invention claimed is:

1. A process for producing a naphtha stream comprising:

a) providing a kerosene stream to a hydrocracking reactor;

b) hydrocracking the kerosene stream in the presence of a hydrogen stream and a hydrocracking catalyst in the hydrocracking reactor at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction;

c) adjusting one or more of the hydrocracking conditions to maintain a ratio of the light naphtha fraction to the heavy naphtha fraction of at least about 2 by weight in the hydrocracked effluent stream while maintaining the net conversion of at least about 90%; and d) obtaining a naphtha stream comprising the ratio of the light naphtha fraction to the heavy naphtha fraction of at least about 2 by weight from the hydrocracking effluent stream;

e) reforming at least a portion of the heavy naphtha fraction in a reforming unit operating under reforming conditions to produce a heavy naphtha reformate stream; and f) passing the heavy naphtha reformate stream to a debutanizer to strip off the light end hydrocarbons to provide the heavy naphtha reformate product.

2. The process of claim 1 further comprising:

a) splitting at least a portion of the naphtha stream in a naphtha splitter column to provide the light naphtha fraction and the heavy naphtha fraction;

b) isomerizing the light naphtha fraction to provide a light naphtha isomerate product; and c) blending the light naphtha isomerate product and the heavy naphtha reformate product to obtain gasoline having a target octane rating from about 85 to about 100.

3. The process of claim 2 further comprising passing the naphtha stream to a naphtha hydrotreating reactor or a guard bed to provide a hydrotreated effluent stream prior to splitting the portion of naphtha stream.

4. The process of claim 2, wherein the step of isomerizing the light naphtha fraction comprises:

a) at least a portion of the light naphtha fraction in an isomerization unit operating under isomerization conditions to produce a light naphtha isomerate stream;

b) passing the light naphtha isomerate stream to a stabilizer to provide a stabilized isomerized stream comprising branched hydrocarbons; and c) passing the stabilized isomerized stream to a deisohexanizer to separate a deisohexanizer recycle stream comprising linear hexane, cyclic hydrocarbons, and monomethyl-branched pentane to provide the light naphtha isomerate product.

5. The process of claim 4, wherein the isomerization conditions comprise an isomerization temperature from about 40° C. to about 250° C. and an isomerization pressure from about 100 kPa(g) to about 10000 kPa(g).

6. The process of claim 1, wherein adjusting the one or more of the hydrocracking conditions comprises varying the hydrocracking temperature from about 300° C. to about 425° C.

7. The process of claim 1, wherein adjusting the one or more of the hydrocracking conditions comprises varying the LHSV from about 1 $hr^{-1}$ to about 4 $hr^{-1}$.

8. The process of claim 7, wherein the LHSV is varied by varying a feed rate of the kerosene stream to the hydrocracking reactor.

9. The process of claim 8, wherein the feed rate is varied by bypassing a portion of the kerosene stream around the kerosene hydrocracking reactor.

10. The process of claim 1 further comprising adjusting the one or more hydrocracking conditions to maintain a yield of the light naphtha fraction to vary by no more about 5% of the net hydrocracked effluent stream.

11. The process of claim 1, wherein the hydrocracking conditions comprise a hydrogen pressure from about 2757 kPa(g) (400 psig) to about 5515 kPa(g) (800 psig).

12. The process of claim 1, wherein the reforming conditions comprise a reforming temperature from about 260° C. to about 560° C. and a reforming pressure from about 100 kPa(g) to about 2000 kPa(g).

13. The process of claim 1, wherein the step of the obtaining the naphtha stream comprises fractionating the hydrocracked effluent stream to provide the naphtha stream.

14. The process of claim 1, further comprising at least one of:

a) sensing at least one parameter of the process for producing a naphtha stream and generating a signal or data from the sensing;

b) generating and transmitting said signal; or c) generating and transmitting said data.

15. The process of claim 1 further comprising:

a) measuring a ratio of the heavy naphtha fraction to the light naphtha via one or more sensors; and b) controlling severity of the hydrocracking reactor by adjusting the hydrocracking temperature to maintain a ratio of the light naphtha fraction to the heavy naphtha fraction of at least about 2 by weight.

16. A process for producing a naphtha stream comprising:

a) providing a kerosene stream to a hydrocracking reactor;

b) hydrocracking the kerosene stream in the presence of a hydrogen stream and a hydrocracking catalyst in the hydrocracking reactor at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction;

c) adjusting the one or more hydrocracking conditions to maintain a yield of the light naphtha fraction to vary by no more about 5% of the net hydrocracked effluent stream while maintaining the net conversion of at least about 90%;

d) obtaining a naphtha stream comprising the ratio of the light naphtha fraction to the heavy naphtha fraction of at least about 2 by weight from the hydrocracked effluent stream;

e) isomerizing at least a portion of the light naphtha fraction in an isomerization unit operating under isomerization conditions to produce a light naphtha isomerate stream;

f) passing the light naphtha isomerate stream to a stabilizer to provide a stabilized isomerized stream comprising branched hydrocarbons; and g) passing the stabilized isomerized stream to a deisohexanizer to separate a deisohexanizer recycle stream comprising linear hexane, cyclic hydrocarbons, and monomethyl-branched pentane to provide the light naphtha isomerate product.

17. The process of claim 16, wherein adjusting the one or more of the hydrocracking conditions comprises varying the hydrocracking temperature from about 300° C. to about 425° C.

18. The process of claim 16, wherein adjusting the one or more of the hydrocracking conditions comprises varying the LHSV from about 1 $hr^{-1}$ to about 4 $hr^{-1}$.

19. A process for producing a naphtha stream comprising:

a) providing a kerosene stream to a hydrocracking reactor;

b) hydrocracking the kerosene stream in the presence of a hydrogen stream and a hydrocracking catalyst in the hydrocracking reactor at hydrocracking conditions comprising a hydrocracking pressure, a hydrocracking temperature, and a liquid hourly space velocity (LHSV) at a net conversion of at least about 90%, to provide a hydrocracked effluent stream comprising liquefied petroleum gas (LPG), heavy naphtha fraction and light naphtha fraction;

c) adjusting one or more of the hydrocracking conditions to maintain a ratio of the light naphtha fraction to the heavy naphtha fraction of at least about 2 by weight in the hydrocracked effluent stream and maintain a yield of the light naphtha fraction to vary by no more about 5% of the net hydrocracked effluent stream while maintaining the net conversion of at least about 90%;

d) obtaining a naphtha stream comprising the ratio of the light naphtha fraction to the heavy naphtha fraction of at least about 2 by weight from the hydrocracked effluent stream;

e) isomerizing at least a portion of the light naphtha fraction in an isomerization unit operating under isomerization conditions to produce a light naphtha isomerate stream;

f) passing the light naphtha isomerate stream to a stabilizer to provide a stabilized isomerized stream comprising branched hydrocarbons; and g) passing the stabilized isomerized stream to a deisohexanizer to separate a deisohexanizer recycle stream comprising linear hexane, cyclic hydrocarbons, and monomethyl-branched pentane to provide the light naphtha isomerate product.

* * * * *